US005308069A

United States Patent [19]

Paquette

[11] Patent Number: 5,308,069

[45] Date of Patent: May 3, 1994

[54] PUTTER APPARATUS FOR THE GAME OF GOLF

[76] Inventor: Ross A. Paquette, 39 Colburn St., North Attleboro, Mass. 02760

[21] Appl. No.: 34,483

[22] Filed: Mar. 19, 1993

[51] Int. Cl.[5] ..... A63B 53/02

[52] U.S. Cl. ..... 273/164.1; 273/80 C; 273/167 G; 273/169; 273/80.2

[58] Field of Search ..... 273/167 R–177 A, 273/77 R, 79, 164.1, 80 R, 80 A, 80 C, 80.1, 80.2; D21/217, 218, 219

[56] References Cited

U.S. PATENT DOCUMENTS

| | | | |
|---|---|---|---|
| D. 232,371 | 8/1974 | Becker . | |
| D. 245,932 | 9/1977 | Lowry . | |
| D. 269,029 | 5/1983 | Lowry | D21/219 |
| 2,478,468 | 8/1949 | Drake | 273/80.2 |
| 2,644,689 | 7/1953 | Putnam | 273/79 |
| 2,932,515 | 4/1960 | May | 273/80.1 |
| 3,042,405 | 7/1962 | Solheim | 273/80 |
| 3,516,674 | 6/1970 | Scarborough | 273/171 X |
| 3,675,923 | 7/1972 | Allen et al. | 273/80.2 |
| 4,010,958 | 3/1977 | Long | 273/169 |
| 4,121,833 | 10/1978 | Preuter | 273/167 G X |
| 4,444,395 | 4/1984 | Reiss | 273/171 |
| 4,508,350 | 4/1985 | Duclos | 273/169 X |
| 4,629,193 | 12/1986 | Pierman | 273/164 |
| 4,702,477 | 10/1987 | Solomon | 273/80.2 X |
| 4,722,528 | 2/1988 | Tsao | 273/164.1 |
| 4,871,174 | 10/1989 | Kobayashi | 273/164.1 |
| 4,902,015 | 2/1990 | Nebbia | 273/80.2 X |
| 4,948,140 | 8/1990 | Antonious | 273/169 |
| 4,979,744 | 12/1990 | Alcala | 273/169 |
| 5,160,141 | 11/1992 | Crews | 273/164.1 |
| 5,197,737 | 3/1993 | Desbiolles et al. | 273/169 |

*Primary Examiner*—Vincent Millin
*Assistant Examiner*—Sebastiano Passaniti
*Attorney, Agent, or Firm*—John A. Haug

[57] ABSTRACT

A putter is shown comprising a body having a generally L-shape in cross-section with the upright portion of the L forming the blade of the putter and the laterally extending portion of the L forming the sole of the putter. A generally U-shaped shaft attachment bar having first and second legs joined by a bight portion with the legs attached to the back of the blade and with a shaft attachment block mounted on the bight of the U-shaped bar. The body and bar have a weight distribution of approximately 30% at each of the toe and heel portions and 40% at the central portion. The sole has a modified three part rocker surface and the blade a conventional 2% loft face.

20 Claims, 2 Drawing Sheets

PUTTER APPARATUS FOR THE GAME OF GOLF

BACKGROUND OF THE INVENTION

This invention relates generally to the game of golf and more particularly to putters used in playing golf.

In a typical round of golf an average golfer will use up to half or even more of his total strokes on the greens with his putter. Any improvement in a golfer's putting can, therefore, have a dramatic effect on the golfer's score. Over the years there have been many attempts to provide a putter that, with the same degree of skill employed by the golfer, will minimize the effects of mis-hits so that fewer puts will be missed.

The balanced weight distribution of a center shafted putter head allows a more consistent stroke of a putter keeping the face of the blade square to the line of the put, however, the conventional center shafted putter is very unforgiving if the ball is not struck precisely at the "sweet spot", i.e., in line with the center of mass, of the head of the putter. A slight mis-hit of as little as one-eighth of an inch results in sufficient torque that can cause a 10% or more dispersion, even with a stroke in alignment with the intended line of the put.

Torque forces were significantly decreased in a prior art design in which the heel and toe portions of the head were increased in weight relative to the central portion with the weighting of the putter a little heavier in the toe than the heel and the shaft attached to the head at the heel thereof. Dispersion was decreased to an approximately 2.5–4% range. However, in this design, due to the weight distribution, the natural tendency in using the putter is to open the face slightly on the back stroke and close the face slightly on the forward stroke. This characteristic requires greater sensitivity, timing and coordination than many, if not most, players have.

It is an object of the present invention to provide a putter which has an improved, low dispersion rate as well as one which is conducive to maintaining the face of the blade square to the line of the put during both the back stroke and the forward stroke. Another object is the provision of a well balanced putter having a good "feel" when striking the ball.

Briefly, a putter made in accordance with the invention, comprises a head having a generally U-shaped shaft attachment bar in which the shaft is attached to the bight of the U-shaped bar and the two legs are attached to the back of the blade of the putter head. According to a feature of the invention the weight of the head, including the shaft attachment bar, is approximately 30% at each of the toe and the heel portions of the putter and 40% in the central portion, the central portion including the shaft attachment bar. The shaft is attached to the bar so that the longitudinal axis of the shaft passes through the center of mass of the putter head so that when the shaft is balanced on the center of gravity of the entire club the head will be balanced in any orientation. According to another feature of the invention the sole of the putter is formed with a modified rocker configuration having three flat portions to provide several stable angular orientations for a golfer to set up with. According to yet another feature of the invention the mass of the putter increases in the direction going from the top surface of the face to the sole.

Various additional objects and advantages of the present invention will become apparent from the following detailed description and accompanying drawings.

BRIEF DESCRIPTION OF THE DRAWINGS

In the accompanying drawings in which the preferred embodiment of the invention is illustrated.

Figure 1:
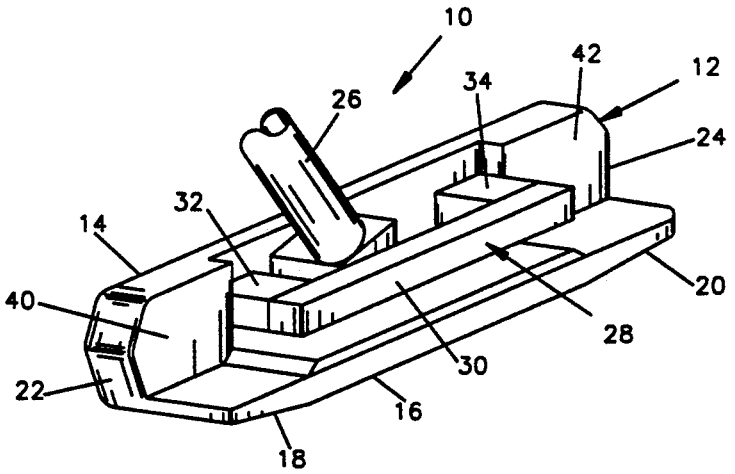
FIG. 1 is a perspective view showing the back of a putter made in accordance with the invention, the shaft broken away for purposes of illustration.
Figure 2:
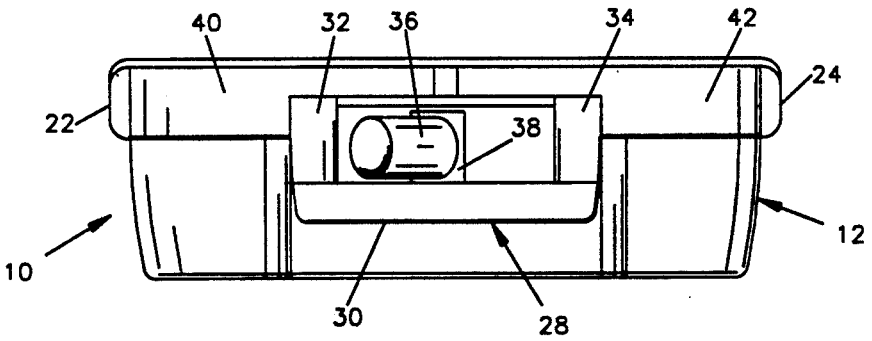
FIG. 2 is a top plan view of the putter head of FIG. 1.
Figure 3:
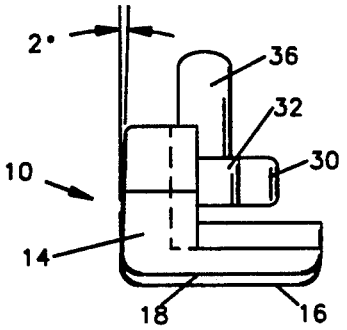
FIG. 3 is a side view of FIG. 2.
Figure 4:
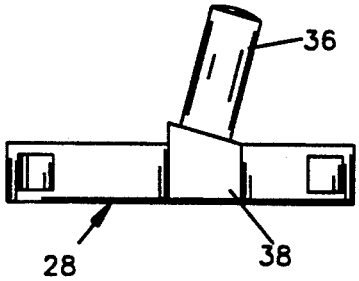
FIGS. 4 and 5 are front and top views respectively of a shaft attachment bar used in the FIGS. 1–3 apparatus.
Figure 5:
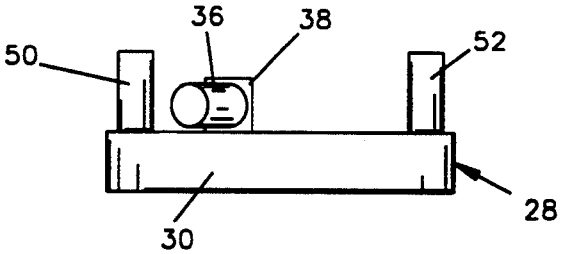
Figure 6:
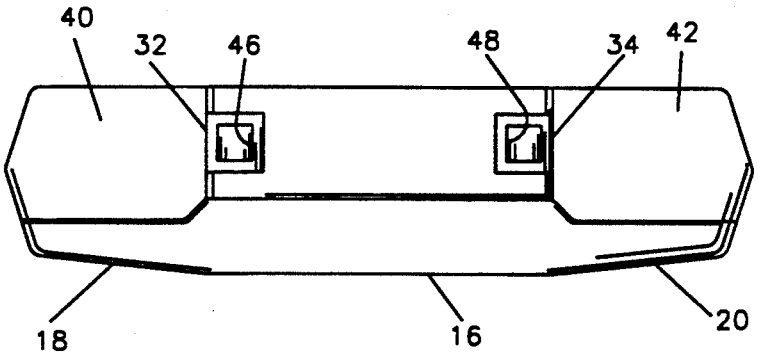
FIG. 6 is a rear elevational view of the FIG. 1–3 apparatus shown with the shaft attachment bar removed.

Turning now to the drawings, numeral 10 designates a putter apparatus made in accordance with the invention comprising a generally L-shaped, in cross-section, head 12 formed of suitable material such as a zinc-aluminum alloy to provide a soft yet solid feel when striking a ball. Head 12 has a blade portion 14, the upright portion of the "L", extending from a heel side 22 to a toe side 24, formed with a loft face of two degrees, or in other words, eighty-eight degrees relative to a plane in which the central portion of the sole or bottom surface of the head 12 lies, although any selected loft can be employed as desired.

The sole of the head, or the laterally extending portion of the "L", has flat portions 18 and 20 extending upwardly slightly on the order of three or four degrees from the central portion 16 in a direction going from one side 22 to the other side 24 so that a user can change the at rest or set up position of the club on the ground in several different stable positions based on what feels comfortable to the user while still keeping the remainder of the club head low or close to the ground. However, it should be realized that other sole configurations can be used within the purview of the invention.

Shaft 26 is attached to head 12 by means of an attachment bar 28. Bar 28 is generally U-shaped having a central or bight portion 30 with legs 32, 34 extending from respective opposite ends thereof and being connected to the back of blade 14. A shaft attachment pin 36 is fixedly attached to a block 38 which in turn is attached to bight portion 30. Pin 36 extends upwardly at a selected angle relative to the the top of bar 28, for example a conventional 70% relative to the plane in which the central sole portion 16 lies.

Head 12 is formed with relatively thick side portions of the back of blade 14 at 40, 42 respectively, providing a selected weight distribution of 30% at both the toe and heel portions 24, 22 respectively, including respective side portions of the sole, and 40% at the central portion including bar 28 and the respective central portion of the sole.

In the embodiment shown, legs 32, 34 are formed integrally with blade portion 14 and are formed with respective recesses 46, 48 at their distal free ends and bar 28 is provided with peg portions 50, 52 attached to bight portion 30 which are pressed into respective recesses 46, 48 forming an interference fit. If desired, peg portions 50, 52 can be tapered slightly, and complimentary shaped surfaces provided in recesses 46, 48, and an epoxy can be added to form a mechanical lock between surface imperfections of the pegs and recesses. If desired, a series of ridges also can be formed in one or both mating surfaces to facilitate the locking action of the epoxy with the respective surfaces.

A typical putter made in accordance with the invention has a total width of four and one-quarter inches, the toe and heel each being one and one-eighth inches wide and each comprising 30% of the total weight of the head. The central portion 16 of the sole has a depth of approximately five-sixteenths of an inch and the blade portion 14 is approximately seven-eights of an inch high. The bight portion of the attachment bar is two inches long in the direction of the width of the putter and is formed of five-sixteenth square material. It will be realized that the head could be formed having any desired width but for the preference of most golfers would be limited to five inches or so. While the weight of conventional putters is generally between 11 to 11.3 ounces the above putter, made of zinc-aluminum alloy is approximately 10.3 ounces.

The above putter was subjected to a cad-cam computer simulated test along with two conventional center shafted putters to determine the dispersion rate resulting from mis-hits using a force required to send a ball twenty feet on a flat surface having a stimpmeter reading of 7.5, which is the national standard for the speed of greens according to the United States Greenskeepers Association. The three putters, when hit on the "sweet-spot", i.e., at the center of mass, resulted in the same manner directing the ball toward the hole. The putters were then mis-hit at various locations on either side of dead center. The dispersion rate increased in the conventional putters from 3% at one-quarter of an inch off center to 12% at three-quarters of an inch off center. Mis-hits toward the heel had even higher dispersion rates. On the other hand, the dispersion rate of the putter made in accordance with the invention was 1.8% at one-quarter of an inch off center and 2.1% at three-quarters of an inch off center.

Suspending the head through a two point connection to the back portion of the blade of various widths can be employed to reduce the torque effect. Widths of up to four and one-half inches have been constructed, however the "feel" of the putter is progressively adversely affected as the width is increased above approximately two inches. On the other hand widths as small as one inch improve the solid feel of the putter but as the width decreases the putter becomes more difficult to control, particularly when a 30–40–30 percent weight distribution is maintained. The optimum width of the attachment bar is approximately two inches for a zinc-aluminum alloy head four and one-quarter inches wide with the attachment of the bar made inboard of the toe and heel portion and with a 30–40–30 % weight distribution.

Although the invention has been described with respect to a specific preferred embodiment thereof, variations and modifications will become apparent to those skilled in the art. It is, therefore, the intention that the appended claims be interpreted as broadly as possible in view of the prior art to include all such variations and modifications.

I claim:

1. Putter apparatus for use in the game of golf comprising a body having a generally flat, upright blade portion extending along a longitudinal axis from a first toe side through a central portion to a second heel side, the body being generally L shaped in a cross section taken perpendicular to the longitudinal axis, the body having a back portion, a generally U-shaped shaft attachment bar having first and second legs joined together by a bight portion, the first and second legs attached to the back portion with the bight portion extending generally laterally and means to attach a shaft to the bight portion to mount the body to the shaft through the first and second legs, the portion of the body to which the legs are attached forming the central portion and the body and the attachment bar having a weight distribution of toe side, central portion and heel side of 30%–40%–30% respectively.

2. Putter apparatus according to claim 1 in which the upright portion of the L forms the blade portion and the laterally extending portion of the L forms a sole, the toe and heel sides of the body being formed with a thicker upright portion than the central portion.

3. Putter apparatus according to claim 1 in which the body has a laterally extending generally flat top surface and the legs are attached to the body below the top surface.

4. Putter apparatus according to claim 3 in which the means to attach the shaft to the bight portion includes a pin mounting block attached to the bight portion and positioned below the top surface.

5. Putter apparatus according to claim 1 in which the attachment bar is approximately two inches long.

6. Putter apparatus according to claim 1 in which the body is approximately four and one-quarter inches from the toe side to the heel side and the shaft attachment bar extends approximately two inches and is centrally disposed relative to the toe and heel sides.

7. Putter apparatus according to claim 6 in which the body has a bottom sole portion approximately one and five-sixteenths inches in depth and the blade is seven-eighths of an inch high.

8. Putter apparatus according to claim 1 in which the means to attach the shaft to the bight portion includes a pin which extends from the body at a selected angle and is located laterally so that a longitudinal axis of the shaft passes through the center of mass of the body thereby providing optimum balance of the putter apparatus.

9. Putter apparatus for use in the game of golf comprising a body having a generally flat, upright blade portion extending along a longitudinal axis from a first toe side through a central portion to a second heel side, the body being generally L-shaped in a cross section taken perpendicular to the longitudinal axis, the body having a back portion, a generally U-shaped shaft attachment bar having first and second legs joined together by a bight portion, the first and second legs attached to the back portion with the bight portion extending generally laterally and means to attach a shaft to the bight portion to mount the body to the shaft through the first and second legs, the means to attach the shaft to the bight portion includes a pin mounting block attached to the bight on a side of the bight facing the body.

10. Putter apparatus according to claim 9 in which the portion of the body to which the legs are attached form the central portion, the body and attachment bar having a weight distribution of toe side, central portion and heel side of 30%–40%–30% respectively.

11. Putter apparatus according to claim 9 in which the attachment bar is approximately two inches long.

12. Putter apparatus for use in the game of golf comprising a body having a generally flat, upright blade portion extending along a longitudinal axis from a first toe side through a central portion including the longitudinal center of the body to a second heel side, the body having a back portion, a generally U-shaped shaft attachment bar having first and second legs joined together by a bight portion, the first and second legs attached to the back portion with the bight portion extending generally laterally and being centered relative to the toe side and the heel side and means including a pin mounting block having a longitudinal center attached to the bight portion with the longitudinal center of the block being on the heel side of a plane passing through the longitudinal center of the body and perpendicular to the longitudinal axis to mount the body to the shaft through the first and second legs.

13. Putter apparatus according to claim 12 in which the body is generally L-shaped in a cross-section taken perpendicular to the longitudinal axis, the upright portion of the L forming the blade portion and the laterally extending portion of the L forming a sole, the portion of the body to which the legs are attached forming the central portion, the toe and heel sides of the body being formed with a thicker upright portion than the central portion.

14. Putter apparatus according to claim 12 in which the portion of the body to which the legs are attached form the central portion, the body and attachment bar having a weight distribution of toe side, central portion and heel side of 30%-40%-30% respectively.

15. Putter apparatus according to claim 12 in which the body has a laterally extending flat top surface and the legs are attached to the body below the top surface.

16. Putter apparatus according to claim 12 in which the pin mounting block is attached to the bight portion on a side thereof facing the body.

17. Putter apparatus according to claim 12 in which the attachment bar is approximately two inches long.

18. Putter apparatus according to claim 12 in which the body is approximately four and one-quarter inches from the toe side to the heel side and the shaft attachment bar extends approximately two inches and is centrally disposed relative to the toe and heel sides.

19. Putter apparatus according to claim 12 in which the body has a bottom sole portion approximately one and five-sixteenths inches in depth and the blade is seven-eighths of an inch high.

20. Putter apparatus according to claim 12 in which the means to attach the shaft to the bight portion includes a pin which extends from the body at a selected angle and is located between the toe side and the heel side so that a longitudinal axis of a shaft received on the pin passes through the center of mass of the putter apparatus.

* * * * *